US012660940B2

(12) United States Patent
Pearce et al.

(10) Patent No.: US 12,660,940 B2
(45) Date of Patent: Jun. 23, 2026

(54) MATTRESSES INCLUDING A COIL LAYER AND AN ELASTOMERIC CUSHIONING ELEMENT

(71) Applicant: Purple Innovation, LLC, Lehi, UT (US)

(72) Inventors: Tony M. Pearce, Alpine, UT (US); Lars Christen Hamilton, Alpine, UT (US); Tanner Rick Wheadon, Lehi, UT (US)

(73) Assignee: Purple Innovation, LLC, Lehi, UT (US)

( * ) Notice: Subject to any disclaimer, the term of this patent is extended or adjusted under 35 U.S.C. 154(b) by 191 days.

(21) Appl. No.: 17/735,795

(22) Filed: May 3, 2022

(65) Prior Publication Data

US 2022/0257025 A1 Aug. 18, 2022

Related U.S. Application Data

(63) Continuation of application No. 15/816,983, filed on Nov. 17, 2017, now Pat. No. 11,317,733.

(51) Int. Cl.
*A47C 27/20* (2006.01)
*A47C 27/00* (2006.01)
(Continued)

(52) U.S. Cl.
CPC ..... *A47C 27/20* (2013.01); *A47C 27/001* (2013.01); *A47C 27/056* (2013.01); *A47C 27/06* (2013.01);
(Continued)

(58) Field of Classification Search
CPC ..... A47C 27/20; A47C 27/001; A47C 27/056; A47C 27/06; A47C 27/064; A47C 27/146;
(Continued)

(56) References Cited

U.S. PATENT DOCUMENTS 174,344 A * 3/1876 Andrews ..... F16K 3/26 251/282
698,529 A 4/1902 Marshall
(Continued)

FOREIGN PATENT DOCUMENTS

CN 2272697 Y 1/1998
CN 101568281 A 10/2009
(Continued)

OTHER PUBLICATIONS

Tempur Sealy International, Llc, et al., Images Showing a Scrim Fabric on a Gel Cushioning Element from a Purple Mattress (circa 2015, provided to Applicant's counsel on Jul. 31, 2023).
(Continued)

*Primary Examiner* — Jonathan Liu
(74) *Attorney, Agent, or Firm* — Foley & Lardner LLP

(57) ABSTRACT

A mattress assembly includes a base layer, a coil layer disposed over the base layer, an upper layer disposed over the coil layer, and an elastomeric cushioning element disposed over the upper layer. The coil layer may include a plurality of pocketed coils. Furthermore, the elastomeric cushioning element may have a thickness within a range of about 2.0 inches to about 4.5 inches. Furthermore, the elastomeric cushioning element may form between about 15.0% and about 32.0% of an overall thickness of the mattress assembly. A method of forming a mattress assembly includes disposing a coil layer over a base layer, disposing an upper layer over the coil layer, disposing an elastomeric cushioning element over the upper layer, and disposing an outer covering over at least the upper layer.

19 Claims, 6 Drawing Sheets

(51) Int. Cl.

| | |
|---|---|
| ***A47C 27/05*** | (2006.01) |
| ***A47C 27/06*** | (2006.01) |
| ***A47C 27/14*** | (2006.01) |
| ***A47C 27/15*** | (2006.01) |

(52) U.S. Cl.
CPC ..... *A47C 27/064* (2013.01); *A47C 27/146* (2013.01); *A47C 27/148* (2013.01); *A47C 27/15* (2013.01)

(58) Field of Classification Search
CPC ..... A47C 27/148; A47C 27/15; A47C 27/144; A47C 27/062; A47C 27/05; A47C 27/088; A47C 27/16; A47C 7/35; A47C 7/18; A47C 23/002; B68G 7/051
See application file for complete search history.

(56) References Cited

U.S. PATENT DOCUMENTS 3,512,192 A * 5/1970 Simon ..... D06N 3/06 5/740
4,092,752 A * 6/1978 Dougan ..... A47C 31/001 521/906
4,213,214 A * 7/1980 Gilhooly ..... A47C 27/001 5/679
4,234,981 A * 11/1980 Hanson ..... A47C 27/00 5/721
4,369,284 A 1/1983 Chen
4,471,020 A * 9/1984 McCarthy ..... B29D 99/0025 264/257
4,504,991 A * 3/1985 Klancnik ..... B32B 5/028 297/DIG. 5
4,618,213 A * 10/1986 Chen ..... A61C 15/041 524/505
4,685,727 A * 8/1987 Cremer ..... A47C 7/74 297/180.14
4,866,799 A * 9/1989 Glackin ..... A47C 31/001 5/716
5,065,485 A * 11/1991 Zocco ..... A47C 31/105 29/525.04
5,107,558 A * 4/1992 Luck ..... A47C 27/15 5/702
5,179,742 A * 1/1993 Oberle ..... A47C 27/22 5/727
5,327,596 A * 7/1994 Wallace ..... A47C 27/15 5/655.7
5,336,708 A 8/1994 Chen
5,613,257 A * 3/1997 Graebe ..... A47C 27/148 5/653
5,749,111 A 5/1998 Pearce
5,994,450 A 11/1999 Pearce
6,026,527 A 2/2000 Pearce
6,397,418 B1 6/2002 Stjerna
6,413,458 B1 7/2002 Pearce
6,523,812 B1 * 2/2003 Spinks ..... A47C 27/064 5/655.8
6,701,557 B2 * 3/2004 Barman ..... A47C 27/053 5/736
7,076,822 B2 7/2006 Pearce
7,581,271 B2 * 9/2009 Gladney ..... A47C 27/064 5/699
7,640,611 B1 * 1/2010 Kluft ..... A47C 27/064 5/718
7,730,566 B2 * 6/2010 Flick ..... A61G 7/05738 5/655.5
7,757,322 B2 * 7/2010 An ..... A47C 27/062 5/722
7,964,664 B2 6/2011 Pearce
8,006,360 B2 * 8/2011 Richmond ..... B29C 48/001 5/716
8,353,072 B2 * 1/2013 Klancnik ..... A47C 31/001 5/954
8,429,776 B2 * 4/2013 Klancnik ..... A47C 31/001 5/716
8,434,748 B1 5/2013 Pearce et al.
8,607,387 B2 * 12/2013 Flick ..... A47C 7/0213 5/655.5
8,628,067 B2 1/2014 Pearce et al.
8,910,334 B2 * 12/2014 Lafleche ..... A61G 7/05715 5/724
8,918,934 B2 * 12/2014 Roma ..... A47C 27/20 5/717
8,919,750 B2 12/2014 Pearce et al.
8,932,692 B2 1/2015 Pearce
8,997,279 B1 * 4/2015 McKay ..... A47C 21/048 5/652.2
9,032,571 B2 * 5/2015 Rancourt ..... A47C 27/144 5/655.5
9,427,090 B2 8/2016 Mossbeck et al.
10,357,113 B2 7/2019 Gladney
10,582,793 B1 * 3/2020 McMahan ..... B32B 5/32
10,807,811 B2 10/2020 Whatcott
10,881,217 B2 1/2021 Moon et al.
11,571,075 B2 * 2/2023 Stojanovic ..... A47C 27/148
11,633,049 B1 * 4/2023 Waggoner ..... A47C 27/001 5/727
2003/0096899 A1 5/2003 Pearce
2003/0135930 A1 * 7/2003 Varese ..... A47C 27/148 5/722
2004/0133988 A1 7/2004 Barber
2004/0226098 A1 11/2004 Pearce
2005/0223667 A1 * 10/2005 McCann ..... A47C 27/085 52/403.1
2005/0288749 A1 12/2005 Lachenbruch
2007/0050905 A1 * 3/2007 Fowkes ..... A47K 3/12 4/579
2007/0135878 A1 6/2007 Lachenbruch
2007/0246157 A1 * 10/2007 Mason ..... A47C 27/085 264/299
2008/0229507 A1 * 9/2008 Healy ..... A47C 27/15 5/691
2009/0013476 A1 * 1/2009 Rinchetti ..... A47C 27/14 5/717
2009/0062432 A1 3/2009 Doesburg et al.
2009/0100606 A1 4/2009 An
2009/0246449 A1 * 10/2009 Jusiak ..... A47C 27/085 428/99
2009/0261518 A1 * 10/2009 DeFranks ..... A47C 27/065 267/166
2009/0288259 A1 * 11/2009 Lean ..... B29C 70/64 264/45.4
2010/0005594 A1 1/2010 Rancourt et al.
2010/0005595 A1 * 1/2010 Gladney ..... A47C 27/15 156/219
2010/0146709 A1 6/2010 Lafleche et al.
2010/0192299 A1 * 8/2010 Schermel ..... A47C 27/085 5/717
2010/0227091 A1 9/2010 Pearce
2010/0237082 A1 * 9/2010 Fernandez ..... A47C 27/16 428/152
2010/0319137 A1 * 12/2010 Witherell ..... A47C 27/056 5/717
2011/0173757 A1 * 7/2011 Rensink ..... A47C 27/15 5/655.5
2011/0179579 A1 * 7/2011 Henderson ..... A47C 23/007 5/717
2011/0197363 A1 * 8/2011 Kokenes ..... B32B 27/08 428/317.1
2011/0197367 A1 * 8/2011 Mossbeck ..... A47C 27/064 5/655.8
2011/0302721 A1 * 12/2011 Khambete ..... A47C 27/06 29/428
2012/0244312 A1 9/2012 Pearce et al.
2013/0031726 A1 * 2/2013 Demoss ..... A47C 27/064 267/180
2013/0081209 A1 * 4/2013 Young ..... A47C 27/063 5/739
2013/0152305 A1 * 6/2013 Lall ..... A47C 27/122 5/400

(56) References Cited

U.S. PATENT DOCUMENTS

| | | | | |
|---|---|---|---|---|
| 2013/0174344 | A1* | 7/2013 | Klancnik | A47C 27/15 428/221 |
| 2013/0205509 | A1* | 8/2013 | Chen | A47C 27/146 5/737 |
| 2014/0130265 | A1* | 5/2014 | Lauer | A47C 27/148 5/727 |
| 2014/0165292 | A1* | 6/2014 | Gladney | A47C 27/05 5/717 |
| 2014/0208517 | A1* | 7/2014 | Gross | A47C 27/15 5/691 |
| 2014/0325763 | A1* | 11/2014 | Mason | B29C 44/06 264/154 |
| 2014/0359939 | A1* | 12/2014 | Carlitz | A47C 27/15 156/254 |
| 2014/0373281 | A1* | 12/2014 | Mossbeck | A47C 27/053 5/718 |
| 2015/0067967 | A1* | 3/2015 | Tyree | A47C 27/15 5/691 |
| 2015/0096121 | A1* | 4/2015 | Scarleski | A47C 21/028 5/499 |
| 2015/0217534 | A1* | 8/2015 | Rancourt | A47C 27/085 156/245 |
| 2015/0223622 | A1* | 8/2015 | Mobley | B32B 7/14 5/636 |
| 2015/0231007 | A1* | 8/2015 | Vrzalik | B32B 37/00 156/60 |
| 2015/0305515 | A1* | 10/2015 | Arendoski | A47C 27/148 5/727 |
| 2016/0262561 | A1 | 9/2016 | Pearce et al. | |
| 2017/0189238 | A1* | 7/2017 | Andrews | A61L 26/008 |
| 2017/0251825 | A1 | 9/2017 | Pearce | |
| 2017/0251838 | A1 | 9/2017 | Whatcott | |
| 2018/0049559 | A1* | 2/2018 | Jewett | A47C 27/062 |
| 2018/0168361 | A1* | 6/2018 | Patmore | A47C 27/22 |
| 2018/0368584 | A1* | 12/2018 | Jewett | B32B 5/06 |
| 2019/0150629 | A1 | 5/2019 | Pearce | |
| 2019/0390025 | A1* | 12/2019 | Sakaguchi | C08K 3/013 |
| 2023/0127744 | A1 | 4/2023 | Mcguire et al. | |

FOREIGN PATENT DOCUMENTS

| | | | | |
|---|---|---|---|---|
| CN | 105101846 | A | 11/2015 | |
| CN | 204734212 | U | 11/2015 | |
| CN | 204838771 | U | 12/2015 | |
| CN | 205321883 | U | 6/2016 | |
| CN | 105747678 | A | 7/2016 | |
| CN | 206565654 | U | 10/2017 | |
| CN | 109793391 | B | 5/2019 | |
| GB | 2 413 111 | A | 10/2005 | |
| JP | S57-201261 | U1 | 12/1982 | |
| JP | S6134951 | * | 3/1986 | A47C 27/064 |
| JP | 2010-530764 | A | 9/2010 | |
| WO | WO-2009/048209 | A1 | 4/2009 | |
| WO | WO-2011/072022 | A1 | 6/2011 | |

OTHER PUBLICATIONS

Extended European Search Report on EP 24205596.0 DTD Apr. 4, 2025.

European Patent Office as International Searching Authority, International Search Report and Written Opinion, International Application No. PCT/US2018/060680, Dec. 20, 2018.

European Sleep Design European Mattress Systems, "Why is your coil fabric polypropylene instead of natural cotton?," https://www.sleepdesign.com/Why-I s-Y ou r-Coil-Fabric-Polypropylene-Instead-Of-Natural-Cotton, Jun. 8, 2016, Exhibit 1017 to "Petition for Inter Partes Review of U.S. Pat. No. 11,317,733," *Tempur Sealy International, Inc.* v. *Purple Innovation, LLC*, USPTO PTAB IPR Case No. 2024-00482, Feb. 14, 2024.

Klancik, Alvin Roy, "Declaration of Alvin Roy Klancnik," Exhibit 1006 to "Petition for Inter Partes Review of U.S. Pat. No. 11,317,733," *Tempur Sealy International, Inc.* v. *Purple Innovation, LLC*, USPTO PTAB IPR Case No. 2024-00482, Feb. 14, 2024.

Kushner, Leslie J., "Petitioners Tempur Sealy International, Inc., Sealy Technology, LLC, and Sealy Mattress Manufacturing Co., LLC's Attorney Declaration," Exhibit 1021 to "Petition for Inter Partes Review of U.S. Pat. No. 11,317,733," *Tempur Sealy International, Inc.* v. *Purple Innovation, LLC*, USPTO PTAB IPR Case No. 2024-00482, Feb. 14, 2024.

Leggett & Platt Bedding Group, "ComfortCore(R)," https://beddingcomponents.com/comfortcore https://web.archive.org/web/20171022185929/https://beddingcomponents.com/comfortcore], Oct. 22, 2017, Exhibit 1015 to "Petition for Inter Partes Review of U.S. Pat. No. 11,317,733," *Tempur Sealy International, Inc.* v. *Purple Innovation, LLC*, US PTO PT AB I PR Case No. 2024-00482, Feb. 14, 2024.

Merriam-Webster, "Definition of innerspring," merriam-webster.com Dictionary, Jan. 2, 2017, https://www.merriam-webster. com/dictionary /innerspring [https://web. archive.org/web/20170102194529/https://www. merriam-webster.com/dictionary/innerspring], Exhibit 1016 to "Petition for Inter Partes Review of U.S. Pat. No. 11,317,733," *Tempur Sealy International, Inc.* v. *Purple Innovation, LLC*, USPTO PTAB IPR Case No. 2024-00482, Feb. 14, 2024.

PCT International Search Report and Written Opinion on PCT/US2018/060680 mailing date May 23, 2019, 11 pages.

Purple Innovation, LLC, "Purple Innovation, LLC's Answer and Affirmative Defenses to Tempur Seal International, Inc., Sealy Technology LLC, and Sealy Mattress Manufacturing Co., LLC's Counterclaims," Aug. 21, 2023, Exhibit 1011 to "Petition for Inter Partes Review of U.S. Pat. No. 11,317,733," *Tempur Sealy International, Inc.* v. *Purple Innovation, LLC*, USPTO PTAB IPR Case No. 2024-00482, Feb. 14, 2024.

Storey, Robson F., "Declaration of Robson F. Storey, Ph.D.," Exhibit 1007 to "Petition for Inter Partes Review of U.S. Pat. No. 11,317,733," *Tempur Sealy International, Inc.* v. *Purple Innovation, LLC*, USPTO PTAB IPR Case No. 2024-00482, Feb. 14, 2024.

Tempur Sealy International, Inc., "Defendants and Counterclaim Plaintiffs Tempur Sealy International, Inc.'s, Sealy Technology LLC's and Sealy Mattress Manufacturing Co., LLC's Preliminary Invalidity Contentions and applicable exhibits," *Purple Innovation, LLC* vs. *Tempur Sealy International, Inc.*, U.S. District Court for the Middle District of North Carolina, Case No. 1:23-CV-00257-CCE-LPA, Dec. 4, 2023.

Tempur Sealy International, Inc., "Petition for Inter Partes Review of U.S. Pat. No. 11,317,733," *Tempur Sealy International, Inc.* v. *Purple Innovation, LLC*, USPTO PTAB IPR Case No. 2024-00482, Feb. 14, 2024.

Tempur Sealy International, Inc., "Tempur Sealy International, Inc.'s, Sealy Technology LLC's, and Sealy Mattress Manufacturing Co., LLC's Answer, Affirmative Defenses, and Counter Claims," Jul. 31, 2023, Exhibit 1012 to "Petition for Inter Partes Review of U.S. Pat. No. 11,317,733," *Tempur Sealy International, Inc.* v. *Purple Innovation, LLC*, US PTO PT AB I PR Case No. 2024-00482, Feb. 14, 2024.

* cited by examiner

MATTRESSES INCLUDING A COIL LAYER AND AN ELASTOMERIC CUSHIONING ELEMENT

CROSS REFERENCE TO RELATED APPLICATION

This application is a continuation of U.S. patent application Ser. No. 15/816,983, filed on Nov. 17, 2017 and titled MATTRESSES INCLUDING AN ELASTOMERIC CUSHIONING ELEMENT AND A POCKETED COIL LAYER AND RELATED METHODS ("the '983 application"), now U.S. Pat. No. 11,317,733, issued May 3, 2022. The entire disclosure of the '983 application is hereby incorporated herein.

TECHNICAL FIELD

Embodiments of the disclosure relate generally to cushioning elements such as mattresses including a pocketed coil layer, and to methods of making such mattresses.

BACKGROUND

Cushioning materials have a variety of uses, such as for mattresses, seating surfaces, shoe inserts, packaging, medical devices, etc. Cushioning materials may be formulated and/or configured to reduce peak pressure on a cushioned body, which may increase comfort for humans or animals, and may protect objects from damage. Cushioning materials may be formed of materials that deflect or deform under load, such as polyethylene or polyurethane foams (e.g., convoluted foam), vinyl, rubber, springs, natural or synthetic fibers, fluid-filled flexible containers, etc. Different cushioning materials may have different responses to a given pressure, and some materials may be well suited to different applications. Cushioning materials may be used in combination with one another to achieve selected properties. For example, mattresses may include pocketed coils in combination with layers of foam, elastomer gels, etc., in order to achieve desired results in the cushioning materials.

In mattresses, springs (e.g., coil springs) may be preferable to foam for their durability and ability to withstand compression. Springs may also impart a feel that may be more desirable to users than that of foam. Despite these advantages, springs may not provide a positive aesthetic and/or tactile experience if they are seen or felt through side panels of the mattress, prompting manufacturers to conceal the feel of springs on the sides of mattresses. One solution includes a wire frame around the edge of the mattress to provide structure to a cover of the mattress. However, the metal of the wire frame may be felt through the cover of the mattress. In addition, such a wire frame may not be particularly suited to handle compression during use and to packing mattresses for shipping and/or storage, such as direct-to-consumer mattresses that are shipped in logs, boxes, etc.

SUMMARY

In some embodiments, a mattress assembly may include a base layer, a coil layer disposed over the base layer, the coil layer comprising a plurality of pocketed coils, an upper layer disposed over the coil layer, and an elastomeric cushioning element disposed over the upper layer, wherein the elastomeric cushioning element has a thickness within a range of about 2.0 inches to about 4.5 inches.

In other embodiments, a mattress assembly may include a base layer, a coil layer disposed over the base layer, an upper layer disposed over the coil layer, and at least one elastomeric cushioning element disposed over the upper layer. The coil layer may include a plurality of pocketed coils, and each pocketed coil of the plurality of pocketed coils may include a plurality of casings and a coil disposed within the plurality of casings. The at least one elastomeric cushioning element may have a thickness within a range of about 2.0 inches to about 4.5 inches.

In further embodiments, a method of forming a mattress assembly may include disposing a coil layer over a base layer, disposing an upper layer over the coil layer, disposing an elastomeric cushioning element over the upper layer, wherein a thickness of the elastomeric cushioning element comprises between about 15.0% and about 32.0% of an overall thickness of the mattress assembly, and disposing an outer covering over at least the upper layer.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

Figure 1:
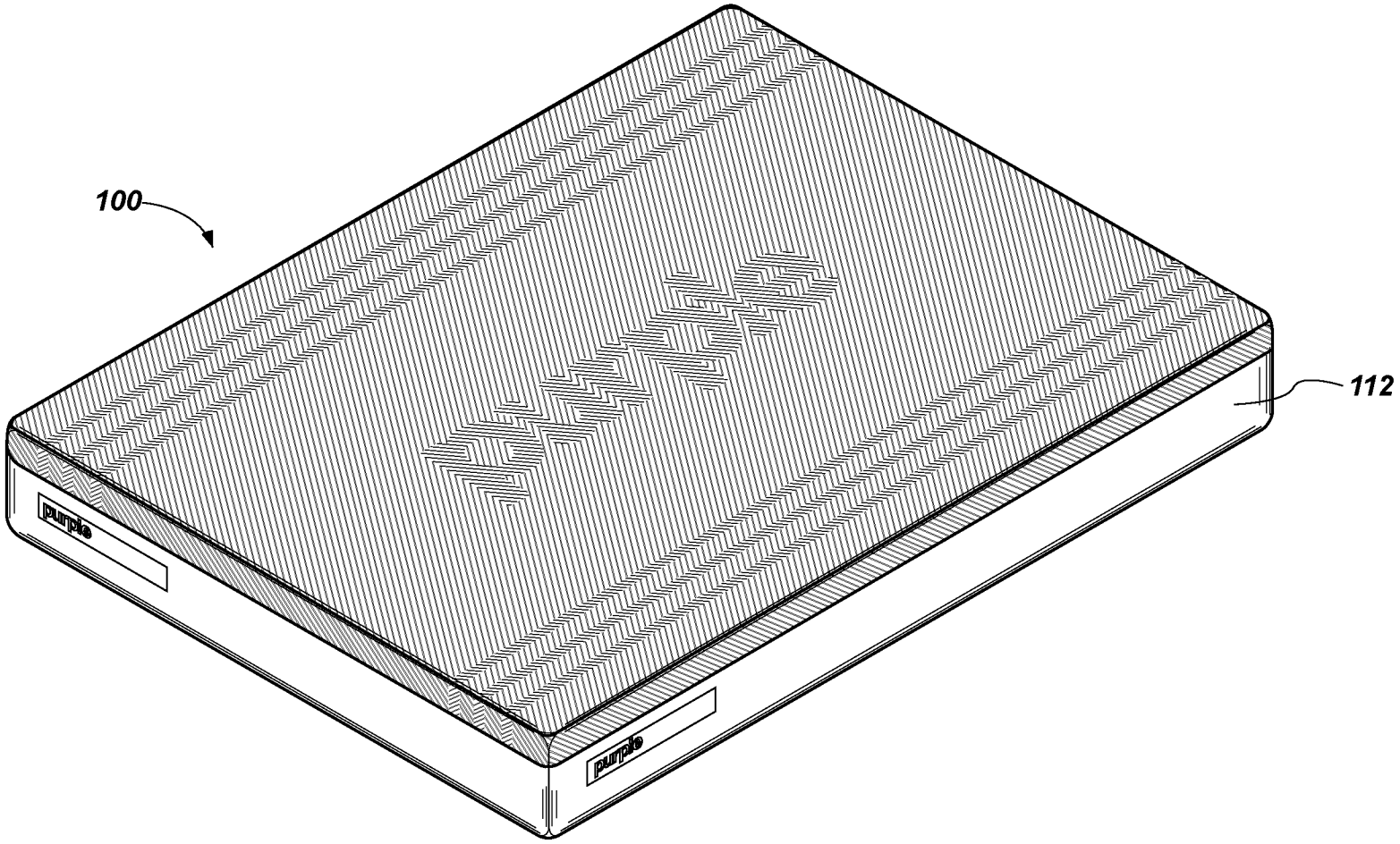
FIG. 1 is a perspective view of a mattress assembly according to the present disclosure.

The following description provides specific details, such as material types, manufacturing processes, uses, and structures in order to provide a thorough description of embodiments of the disclosure. However, a person of ordinary skill in the art will understand that the embodiments of the disclosure may be practiced without employing these specific details. Indeed, the embodiments of the disclosure may be practiced in conjunction with conventional manufacturing techniques and materials employed in the industry.

In the following detailed description, reference is made to the accompanying drawings, which form a part hereof, and in which is shown, by way of illustration, specific embodiments in which the disclosure may be practiced. These embodiments are described in sufficient detail to enable a person of ordinary skill in the art to practice the disclosure. However, other embodiments may be utilized, and structural, procedural, and other changes may be made without departing from the scope of the disclosure. The illustrations presented herein are not meant to be actual views of any particular system, device, structure, or process, but are idealized representations that are employed to describe the embodiments of the disclosure. The drawings presented herein are not necessarily drawn to scale. Similar structures or components in the various drawings may retain the same or similar numbering for the convenience of the reader; however, the similarity in numbering does not mean that the structures or components are necessarily identical in size, composition, configuration, or other property.

As used herein, any relational term, such as "first," "second," "top," "bottom," "upper," "base," etc., is used for clarity and convenience in understanding the disclosure and accompanying drawings, and does not connote or depend on any specific preference or order, except where the context clearly indicates otherwise. For example, these terms may refer to an orientation of elements of a mattress when oriented for sleeping in a conventional manner. Furthermore, these terms may refer to an orientation of elements of a mattress assembly as illustrated in the drawings.

As used herein, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

As used herein, the term "elastomeric polymer" means and includes a polymer capable of recovering its original size and shape after deformation. In other words, an elastomeric polymer is a polymer having elastic or viscoelastic properties. Elastomeric polymers may also be referred to as "elastomers" in the art. Elastomeric polymers include, without limitation, homopolymers (polymers having a single chemical unit repeated) and copolymers (polymers having two or more chemical units).

As used herein, the term "elastomeric block copolymer" means and includes an elastomeric polymer having groups or blocks of homopolymers linked together, such as A-B diblock copolymers and A-B-A triblock copolymers. A-B diblock copolymers have two distinct blocks of homopolymers. A-B-A triblock copolymers have two blocks of a single homopolymer (A) each linked to a single block of a different homopolymer (B).

As used herein, the term "plasticizer" means and includes a substance added to another material (e.g., an elastomeric polymer) to increase a workability of the material. For example, a plasticizer may increase the flexibility, softness, or extensibility of the material. Plasticizers include, without limitation, hydrocarbon fluids, such as mineral oils. Hydrocarbon plasticizers may be aromatic or aliphatic.

As used herein, the term "elastomeric material" means and includes elastomeric polymers and mixtures of elastomeric polymers with plasticizers and/or other materials. Elastomeric materials are elastic (i.e., capable of recovering size and shape after deformation). Elastomeric materials include, without limitation, materials referred to in the art as "elastomer gels," "gelatinous elastomers," or simply "gels."

Embodiments of the present disclosure include a mattress assembly having an elastomeric cushioning element that comprises between about 15.0% and about 32.0% of an overall thickness of the mattress assembly. For example, the elastomeric cushioning element may comprise about 30.8% of the overall thickness of the mattress assembly.

Additional embodiments of the present disclosure include a mattress assembly having a coil layer that includes a plurality of coils with each coil of the plurality of coils being disposed in multiple casings (e.g., bags). For example, each coil may be disposed within two or more polypropylene bags.

Further embodiments of the present disclosure include a mattress assembly having a latex water based adhesive disposed between one or more layers of the mattress assembly.

Figure 2:
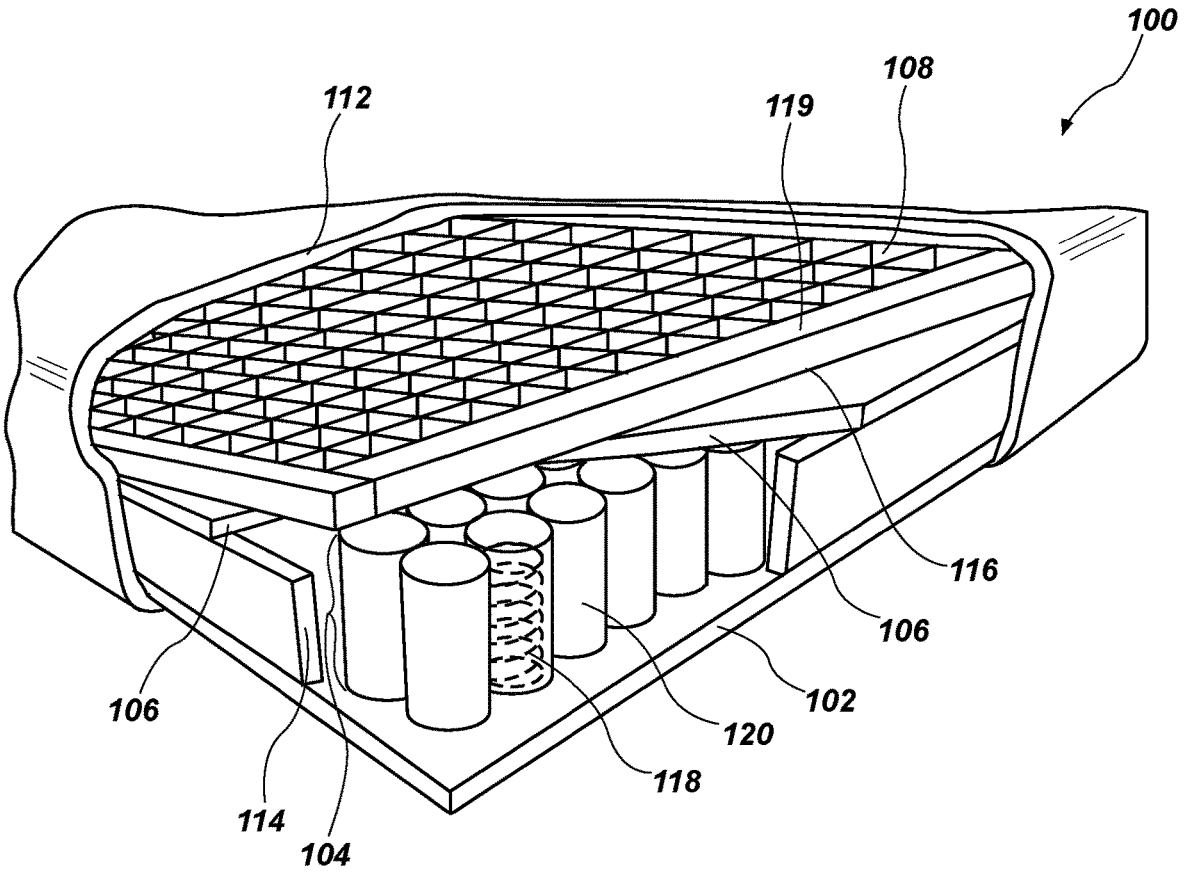
FIG. 2 is a simplified perspective view of the mattress assembly of FIG. 1.

FIG. 1 shows a mattress assembly 100 according to one or more embodiments of the present disclosure. FIG. 2 shows a simplified top perspective view of the mattress assembly 100 of FIG. 1. In FIG. 2, various portions of the mattress assembly 100 are removed to provide a cutaway view and to better show internal components of the mattress assembly 100. Referring to FIGS. 1 and 2 together, in one or more embodiments, the mattress assembly 100 may include a base layer 102, a coil layer 104, an upper layer 106, an elastomeric cushioning element 108, an edge portion 119, one or more side panels 114, and the outer covering 112.

The base layer 102 may have generally planar top and bottom surfaces. The coil layer 104 may be disposed on the top surface of the base layer 102 and between the base layer 102 and the upper layer 106. In particular, the upper layer 106 may be disposed over and may at least substantially extend over the coil layer 104. The elastomeric cushioning element 108 may be disposed over an upper surface of the upper layer 106 and may extend over at least a portion of the upper layer 106. The edge portion 119 may extend around an outer peripheral edge of the elastomeric cushioning element 108. The one or more side panels 114 may extend along outer perimeters of the base layer 102 and the upper layer 106 and may be disposed between the upper layer 106 and the base layer 102. Furthermore, the one or more side panels 114 may extend within a plane perpendicular to a plane defined by the top surface of the base layer 102. The outer covering 112 may extend from the base layer 102 and may at least substantially encase the coil layer 104, upper layer 106, and elastomeric cushioning element 108.

In some embodiments, the mattress assembly 100 may include a stabilization material 116 between the elastomeric cushioning element 108 and the upper layer 106. In some instances, the stabilization material 116 may include a relatively thin material (e.g., cotton spandex blend "scrim") and may be used to provide a surface for adhering (e.g., gluing) the elastomeric cushioning element 108 to surrounding materials, such as another elastomeric cushioning element 108 and/or an upper surface of the upper layer 106. In some embodiments, the stabilization material 116 may comprise a scrim fabric (e.g., a woven or non-woven fabric material) and portions of the elastomeric cushioning element 108 may seep through (e.g., be melt-fused into, bleed through, push through, leak through, pass through, etc.) the scrim fabric of the stabilization material 116. For example, when the elastomeric cushioning element 108 includes a gel material (as described below), portions of the gel material may be heat fused through the stabilization material 116.

The portions of the elastomeric cushioning element 108 that extend through the scrim fabric of the stabilization material 116 may create a non-slip surface or reduced slip surface on a lower surface of the stabilization material 116 (e.g., surface that would contact an upper surface of the upper layer 106). The non-slip surface or reduced slip surface created by the elastomeric cushioning element 108 may help the cushioning materials stay in place relative to one another.

Furthermore, in some embodiments, an adhesive may be disposed between the stabilization material 116 and the upper surface of the upper layer 106. However, an adhesive may not be disposed between the edge portion 119 and the upper layer 106. Furthermore, an adhesive may be disposed between the base layer 102 and the coil layer 104. Moreover, an adhesive may be disposed between the coil layer 104 and the upper layer 106. Additionally, an adhesive may be disposed between the one or more side panels 114 and the coil layer 104. In some embodiments the adhesive(s) may include a latex water based adhesive. For instance, in one or more embodiments, the adhesive(s) may include one or more of SIMALFA® 338 and SIMALFA® 310.

In one or more embodiments, the mattress assembly 100 may not include a stabilization material 116 between the coil layer 104 and the upper layer 106 of the mattress assembly 100. However, in some instances, an adhesive may be disposed between the stabilization material 116 and the upper surface of the upper layer 106. For example, the adhesive may include any of the adhesives described above.

In some embodiments, the outer covering 112 may comprise a stretchable material that may be secured to or be integral with the elastomeric cushioning element 108. Such a stretchable material is described in U.S. patent application Ser. No. 15/062,621, to Pearce, filed Mar. 7, 2016, the entire disclosure of which is incorporated herein by this reference.

In one or more embodiments, the base layer 102 and the upper layer 106 may include a polyurethane foam. In additional embodiments, the base layer 102 and the upper layer 106 may include one or more of a memory polyurethane foam, a latex foam rubber, or any other suitable foam. In some embodiments, the base layer 102 may include a polyurethane foam having a nominal density of about 2.0 $lb/ft^3$ and an indention load deflection (ILD) of 55 (i.e., 55 ILD). Additionally, the upper layer 106 may include a polyurethane foam having a nominal density of about 2.0 $lb/ft^3$ and 18 ILD. The one or more side panels 114 may also include a polyurethane foam or any other spacer fabric known in the art. For example, the one or more side panels 114 may include any of the side panels described in U.S. patent application Ser. No. 15/662,934, to Moon et al., filed Jul. 28, 2017, the disclosure of which is incorporated in its entirety by this reference herein.

The coil layer 104 may include a plurality of coils 118 (e.g., steel coils), and each coil 118 of the plurality of coils 118 may be encased in at least one respective casing 120 (e.g., polypropylene socks or bags). For example, each casing 120 may form a pocket for a respective coil 118. In other words, the plurality of coils 118 may include a plurality of pocketed coils 118. In some embodiments, each coil 118 may include a relatively thin-gauge, barrel-shaped (e.g., helical-shaped), knotless coil. Furthermore, in one or more embodiments, each coil 118 may be encased in multiple casings 120. For instance, each coil 118 may be double bagged or triple bagged. In one or more embodiments, the casings 120 may include a polypropylene material.

The casings 120 may include a two-ply polypropylene non-woven material. In one or more embodiments, the polypropylene non-woven material may include one or more of BERRY® products 1430408, 1430379, and 1430538. In some embodiments, each ply of the casings 120 may have a thickness within a range of about 0.10 mm and about 0.40 mm. As a non-limiting example, each ply of the casings 120 may have a thickness within a range of about 0.15 mm and about 0.30 mm. However, any suitable material may be used. The casings 120 may provide sound dampening effects.

For example, the mattress assembly 100 was tested according to a test method of utilizing the application SOUND METER by Abc Apps from the Google Play Store on a Galaxy S6 Active phone to measure sound levels from the mattress assembly 100. During the test method, a 3×3 coil structure having each coil 118 covered by the above-described casings 120 was compressed multiple times for the duration of 15 seconds, and the 3×3 coil structure exhibited an average sound level within a range of about 35 decibels and about 45 decibels. For example, the 3×3 coil structure exhibited an average sound level of about 40 decibels. In comparison, conventional mattresses, when tested according to the above test method, exhibited an average sound level of about 50 decibels. Accordingly, by encasing each coil 118 with multiple casings 120 (e.g., a first casing 120 and a second casing 120), the mattress assembly 100 of the present disclosure may be advantageous over conventional mattress assemblies. For example, the mattress assembly 100 may be quieter than conventional mattresses (e.g., may exhibit about 20% less sound than conventional mattresses).

In some embodiments, each casing 120 of each coil 118 of the plurality of coils 118 may be individual and discrete. In additional embodiments, the casings 120 of the plurality of coils 118 may be connected (i.e., joined) and may form a single body. Furthermore, each coil 118 of the plurality of coils 118 may extend longitudinally in a direction at least substantially orthogonal (i.e., normal) to an upper surface of the base layer 102. Furthermore, the plurality of coils 118 may be oriented next to each other in an array (e.g., rows and columns or a grid pattern) to form the coil layer 104.

Figure 3:
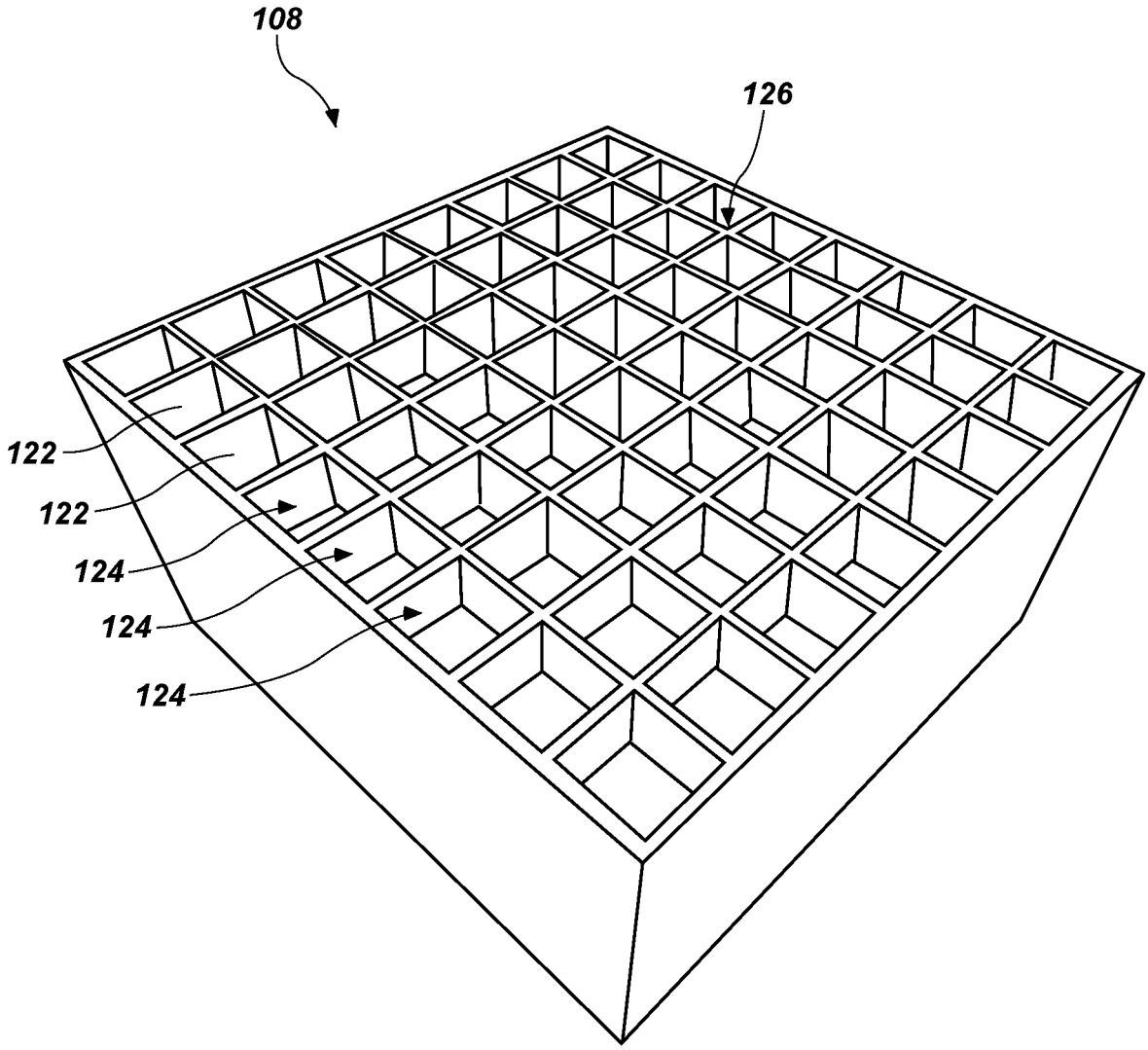
FIG. 3 is a perspective view of an elastomeric cushioning element according to one or more embodiments of the present disclosure.

FIG. 3 a simplified perspective view of the elastomeric cushioning element 108. The elastomeric cushioning element 108 may include a singly-molded elastomeric cushioning element 108. For example, the entirety of the elastomeric cushioning element 108 may be formed via a single molding process. In some embodiments, the elastomeric cushioning element 108 may include buckling walls 122. The buckling walls 122 of the elastomeric cushioning element 108 may be interconnected to one another and may define hollow columns 124 or voids in an expanded form. As used herein, the term "expanded form" means and includes a state in which an elastomeric cushioning element 108 has its original size and shape and wherein the buckling walls 122 are separated and define hollow columns 124.

The buckling walls 122 may extend in two directions, intersecting at right angles, and defining square voids 126. However, in some embodiments, the buckling walls 122 may intersect at other angles and define voids 126 of other shapes, such as triangles, parallelograms, hexagons, etc. The elastomeric cushioning element 108 may comprise additional structures and configurations such as those structures and configurations described in, for example, U.S. Pat. No. 8,434,748, titled "Cushions Comprising Gel Springs," issued May 7, 2013; U.S. Pat. No. 8,628,067, titled "Cushions Comprising Core Structures and Related Methods," issued Jan. 14, 2014; U.S. Pat. No. 8,919,750, titled "Cushioning Elements Comprising Buckling Walls and Methods of Forming Such Cushioning Elements," issued Dec. 30, 2014; and U.S. Pat. No. 8,932,692, titled "Cushions Comprising Deformable Members and Related Methods," issued Jan. 13, 2015, the entire disclosure of each of which is incorporated herein by this reference.

The buckling walls 122 may be formed of an elastomeric material. Elastomeric materials are described in, for example, U.S. Pat. No. 5,994,450, titled "Gelatinous Elastomer and Methods of Making and Using the Same and Articles Made Therefrom," issued Nov. 30, 1999 (hereinafter "the '450 Patent"); U.S. Pat. No. 7,964,664, titled "Gel with Wide Distribution of MW in Mid-Block" issued Jun. 21, 2011; U.S. Pat. No. 4,369,284, titled "Thermoplastic Elastomer Gelatinous Compositions" issued Jan. 18, 1983; U.S. Pat. No. 8,919,750, titled "Cushioning Elements Comprising Buckling Walls and Methods of Forming Such Cushioning Elements," issued Dec. 30, 2014 (hereinafter "the '750 Patent"); the disclosures of each of which are incorporated herein in their entirety by this reference. The elastomeric material may include an elastomeric polymer and a plasticizer. The elastomeric material may be a gelatinous elastomer (also referred to in the art as gel, elastomer gel, or elastomeric gel), a thermoplastic elastomer, a natural rubber, a synthetic elastomer, a blend of natural and synthetic elastomers, etc.

The elastomeric polymer may be an A-B-A triblock copolymer such as styrene ethylene propylene styrene (SEPS), styrene ethylene butylene styrene (SEBS), and styrene ethylene ethylene propylene styrene (SEEPS). For example, A-B-A triblock copolymers are currently commercially available from Kuraray America, Inc., of Houston, TX, under the trade name SEPTON® 4055, and from Kraton Polymers, LLC, of Houston, TX, under the trade names KRATON® E1830, KRATON® G1650, and KRATON® G1651. In these examples, the "A" blocks are styrene. The "B" block may be rubber (e.g., butadiene, isoprene, etc.) or hydrogenated rubber (e.g., ethylene/propylene or ethylene/butylene or ethylene/ethylene/propylene) capable of being plasticized with mineral oil or other hydrocarbon fluids. The elastomeric material may include elastomeric polymers other than styrene-based copolymers, such as non-styrenic elastomeric polymers that are thermoplastic in nature or that can be solvated by plasticizers or that are multi-component thermoset elastomers.

The elastomeric material may include one or more plasticizers, such as hydrocarbon fluids. For example, elastomeric materials may include aromatic-free food-grade white paraffinic mineral oils, such as those sold by Sonneborn, Inc., of Mahwah, NJ, under the trade names BLANDOL® and CARNATION®.

In some embodiments, the elastomeric material may have a plasticizer-to-polymer ratio from about 0.1:1 to about 50:1 by weight. For example, elastomeric materials may have plasticizer-to-polymer ratios from about 1:1 to about 30:1 by weight, or even from about 1.5:1 to about 10:1 by weight. In further embodiments, elastomeric materials may have plasticizer-to-polymer ratios of about 4:1 by weight.

The elastomeric material may have one or more fillers (e.g., lightweight microspheres). Fillers may affect thermal properties, density, processing, etc., of the elastomeric material. For example, hollow microspheres (e.g., hollow glass microspheres or hollow acrylic microspheres) may decrease the thermal conductivity of the elastomeric material by acting as an insulator because such hollow microspheres (e.g., hollow glass microspheres or hollow acrylic microspheres) may have lower thermal conductivity than the plasticizer or the polymer. As another example, metal particles (e.g., aluminum, copper, etc.) may increase the thermal conductivity of the resulting elastomeric material because such particles may have greater thermal conductivity than the plasticizer or polymer. Microspheres filled with wax or another phase-change material (i.e., a material formulated to undergo a phase change near a temperature at which a cushioning element may be used) may provide temperature stability at or near the phase-change temperature of the wax or other phase-change material within the microspheres (i.e., due to the heat of fusion of the phase change). The phase-change material may have a melting point from about 20° C. to about 45° C.

The elastomeric material may also include antioxidants. Antioxidants may reduce the effects of thermal degradation during processing or may improve long-term stability. Antioxidants include, for example, pentaerythritol tetrakis(3-(3,5-di-tert-butyl-4-hydroxyphenyl) propionate), commercially available as IRGANOX® 1010, from BASF Corp., of Iselin, NJ or as EVERNOX®-10, from Everspring Corp. USA, of Los Angeles, CA; octadecyl-3-(3,5-di-tert-butyl-4-hydroxyphenyl) propionate, commercially available as IRGANOX® 1076, from BASF Corp. or as EVERNOX® 76, from Everspring Chemical; and tris(2,4-di-tert-butylphenyl)phosphite, commercially available as IRGAFOS® 168, from BASF Corp. or as EVERFOS® 168, from Everspring Chemical. One or more antioxidants may be combined in a single formulation of elastomeric material. The use of antioxidants in mixtures of plasticizers and polymers is described in columns 25 and 26 of the '450 Patent. The elastomeric material may include up to about 5 wt % antioxidants. For instance, the elastomeric material may include from about 0.10 wt % to about 1.0 wt % antioxidants.

In some embodiments, the elastomeric material may include a resin. The resin may be selected to modify the elastomeric material to slow a rebound of the elastomeric cushioning element 108 after deformation. The resin, if present, may include a hydrogenated pure monomer hydrocarbon resin, such as those commercially available from Eastman Chemical Company, of Kingsport, TN, under the trade name REGALREZ®. The resin, if present, may function as a tackifier, increasing the stickiness of a surface of the elastomeric material.

In some embodiments, the elastomeric material may include a pigment or a combination of pigments. Pigments may be aesthetic and/or functional. That is, pigments may provide the elastomeric cushioning element 108 with an appearance appealing to consumers. In addition, an elastomeric cushioning element 108 having a dark color may absorb radiation differently than an elastomeric cushioning element 108 having a light color.

The elastomeric material may include any type of gelatinous elastomer. For example, the elastomeric material may include a melt-blend of one part by weight of a styrene-ethylene-ethylene-propylene-styrene (SEEPS) elastomeric triblock copolymer (e.g., SEPTON® 4055) with four parts by weight of a 70-weight straight-cut white paraffinic mineral oil (e.g., CARNATION® white mineral oil) and, optionally, pigments, antioxidants, and/or other additives.

The elastomeric material may include a material that may return to its original shape after deformation, and that may be elastically stretched. The elastomeric material may be rubbery in feel, but may deform to the shape of an object applying a deforming pressure better than conventional rubber materials, and may have a durometer hardness lower than conventional rubber materials. For example, the elastomeric material may have a hardness on the Shore A scale of less than about 50, from about 0.1 to about 50, or less than about 5.

Referring again to FIG. 2, a configuration of having the coil layer 104 with the upper layer 106 on top of the coil layer 104 and the elastomeric cushioning element 108 on top of the upper layer 106 may provide advantages over conventional mattress assemblies. For example, in comparison to conventional mattress assemblies, the plurality of coils 118 of the coil layer 104 may better conform to an upper surface of the mattress assembly 100. For instance, when subjected to a weight (e.g., a person on the mattress assembly 100) and a resulting deformation, the plurality of coils 118 of the coil layer 104 may better conform to the deformation. Furthermore, the configuration may provide an increase in lateral stability in comparison to conventional mattress assemblies. Additionally, the foregoing configuration may make methods of manufacturing the mattress assembly 100 easier in comparison to conventional methods of manufacturing mattresses because it removes a need to laminate/glue the coil layer 104 to the elastomeric cushioning element 108. Having the upper layer 106 between the coil layer 104 and the elastomeric cushioning element 108 provides a porous surface to adhere to both of the coil layer 104 and the elastomeric cushioning element 108. Furthermore, the upper layer 106 dampens sound from the coil layer 104.

Figure 4:
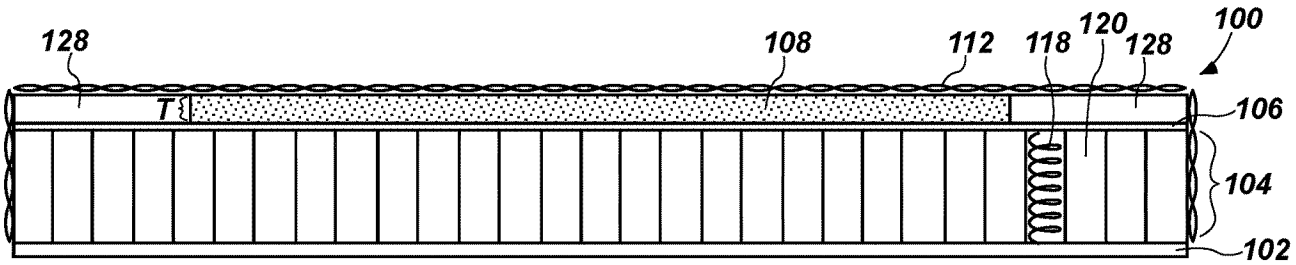
FIG. 4 is a side cross-sectional view of a mattress assembly according to one or more embodiments of the present disclosure.

FIGS. 4-7 show schematic side cross-sectional views of mattress assemblies according to embodiments of the present disclosure. As shown in FIG. 4, in some embodiments, the elastomeric cushioning element 108 may not cover an entirety of an upper surface of the upper layer 106 of the mattress assembly 100. In such embodiments, the mattress assembly 100 may further include one or more segments 128 of foam (e.g., a polyurethane foam) in place of the elastomeric cushioning element 108 to provide an at least substantially planar upper surface of the mattress assembly 100. For instance, the one or more segments 128 of foam may be disposed adjacent to the elastomeric cushioning element 108 on the upper layer 106 of the mattress assembly 100.

In some embodiments, the elastomeric cushioning element 108 may be disposed only over a center portion of the upper layer 106 of the mattress assembly 100. For example, the elastomeric cushioning element 108 may not cover a portion of the upper layer 106 extending around a perimeter of the upper layer 106 of the mattress assembly 100. In such embodiments, the segments of foam 128 may be disposed over the portion of the upper layer 106 extending around a perimeter of the upper layer 106. The foregoing configuration may be utilized with mattress sizes where only one sleeper is expected (i.e., twin and full sized mattress).

In additional embodiments, the elastomeric cushioning element 108 may be disposed only in areas anticipated as predominant sleeping areas of sleepers. For example, the elastomeric cushioning element 108 may include two separate sections centered on opposing longitudinal halves of the mattress assembly 100. The foregoing configuration may be utilized with mattress sizes where two sleepers are expected (i.e., king, queen, and full sized mattresses). Furthermore, the foregoing embodiment is described in further detail with reference to FIG. 8.

Figure 5:
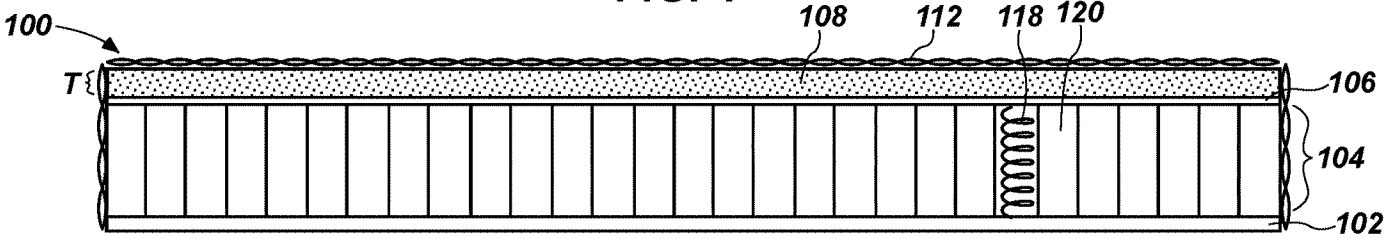
FIG. 5 is a side cross-sectional view of a mattress assembly according to one or more embodiments of the present disclosure.
Figure 6:
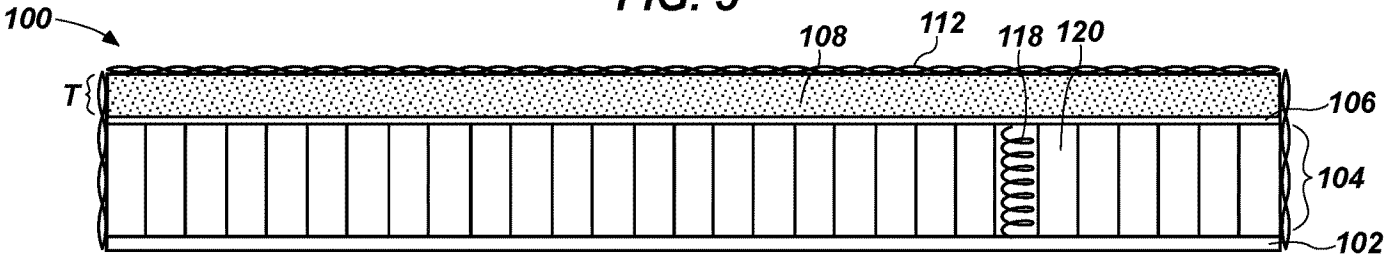
FIG. 6 is a side cross-sectional view of a mattress assembly according to one or more embodiments of the present disclosure.
Figure 7:
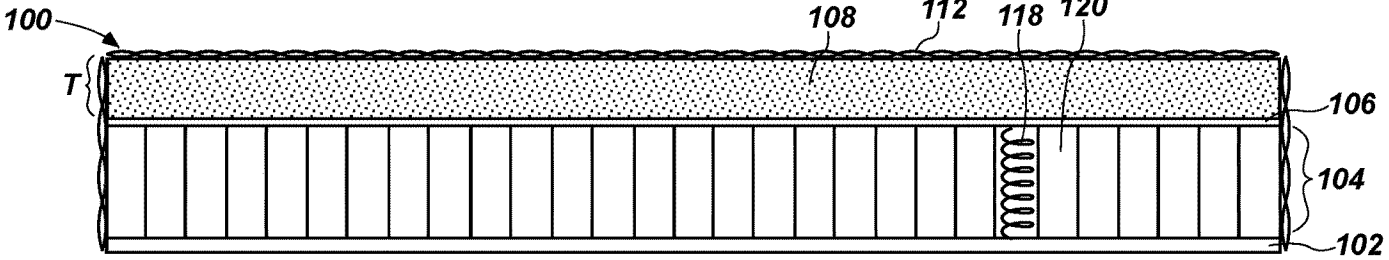
FIG. 7 is a side cross-sectional view of a mattress assembly according to one or more embodiments of the present disclosure.

As show in FIGS. 5-7, a thickness of the elastomeric cushioning element 108 may vary. In some embodiments, the elastomeric cushioning element 108 may have a thickness T of within a range of about 1.5 inches to about 2.5 inches. Furthermore, in some instances, the thickness T of the elastomeric cushioning element 108 may comprise between about 15.0% and about 20.0% of an overall thickness of the mattress assembly 100. For instance, the elastomeric cushioning element 108 may have a thickness T of about 2.0 inches and a thickness T that comprises about 18.2% of the overall thickness of the mattress assembly 100. In additional embodiments, the elastomeric cushioning element 108 may have a thickness T of within a range of about 2.5 inches to about 3.5 inches. Moreover, in some embodiments, the thickness T of the elastomeric cushioning element 108 may comprise between about 20.0% and about 30.0% of an overall thickness of the mattress assembly 100. For example, the elastomeric cushioning element 108 may have a thickness T of about 3.0 inches and a thickness T that comprises about 25.0% of the overall thickness of the mattress assembly 100. In further embodiments, the elastomeric cushioning element 108 may have a thickness T of within a range of about 3.5 inches to about 4.5 inches. Additionally, in one or more embodiments, the thickness T of the elastomeric cushioning element 108 may comprise between about 30.0% and about 35.0% of an overall thickness of the mattress assembly 100. As a non-limiting example, the elastomeric cushioning element 108 may have a thickness T of about 4.0 inches and a thickness T that comprises about 30.8% of the overall thickness of the mattress assembly 100.

Referring still to FIGS. 5-7, in some embodiments, the upper layer 106 of the mattress assembly 100 may have a thickness within a range of about 0.25 inch and about 0.75 inch. For instance, the upper layer 106 of the mattress assembly 100 may have a thickness of about 0.50 inch. Additionally, the coil layer 104 of the mattress assembly 100 may have a thickness (e.g., height) within range of about 6.0 inches and about 9.0 inches. For example, the coil layer 104 of the mattress assembly 100 may have a thickness of about 7.5 inches. Moreover, the base layer 102 of the mattress assembly 100 may a thickness within a range of about 0.50 inch and about 1.50 inches. As a non-limiting example, the base layer 102 may have a thickness of about 1.00 inch.

Figure 8:
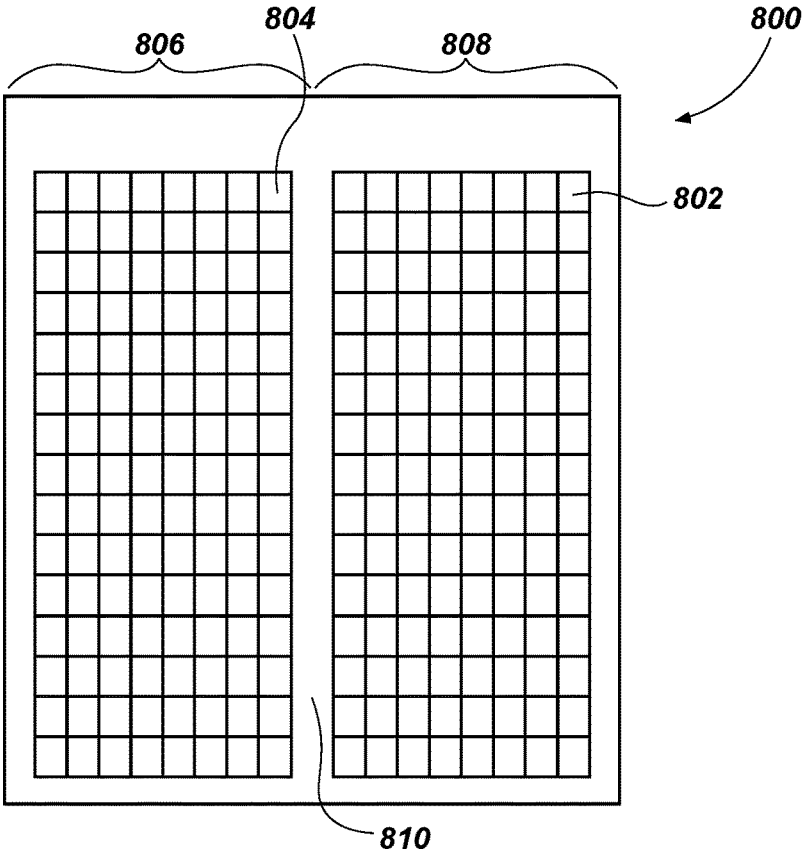
FIG. 8 is a top schematic view of a mattress assembly according to one or more embodiments of the present disclosure.
Figure 9:
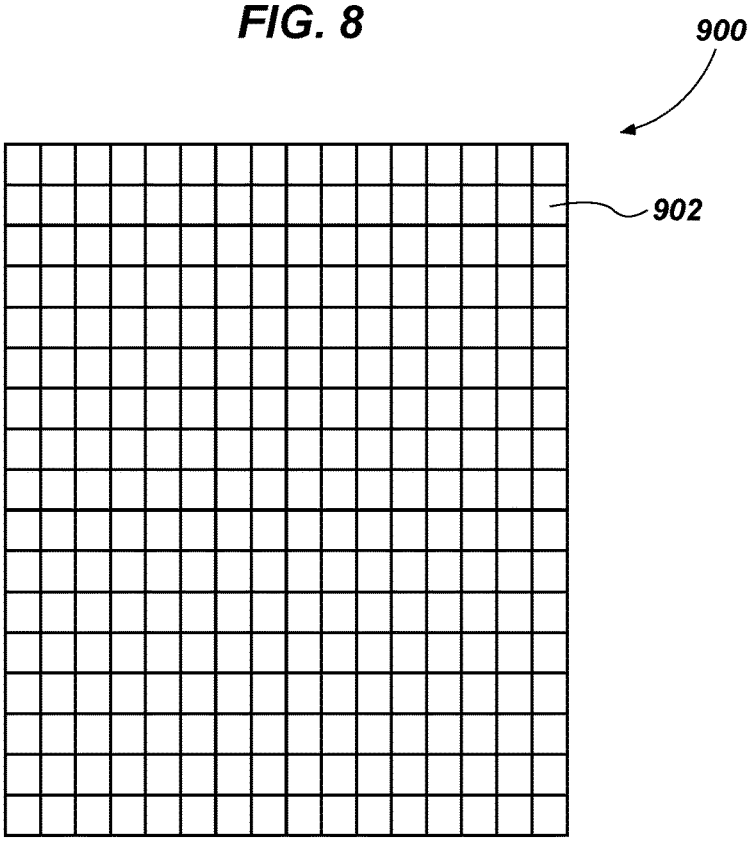
FIG. 9 is a top schematic view of a mattress assembly according to one or more embodiments of the present disclosure.

FIGS. 8 and 9 show top views of mattress assemblies according to embodiments of the present disclosure. As shown in FIG. 8, in some embodiments, the mattress assembly 800 may include one or more elastomeric cushioning element sections 802, 804 (e.g., a plurality of distinct elastomeric cushioning elements). Furthermore, the one or more elastomeric cushioning element sections 802, 804 may be disposed (e.g., located) in anticipated sleeping areas of one or more sleepers. For example, for a mattress size where two sleepers are anticipated (e.g., a queen and/or king size bed), the mattress assembly 800 may include a first elastomeric cushioning element section 802 and a second elastomeric cushioning element section 804. The first elastomeric cushioning element section 802 may be centered longitudinally within a first half 806 of the overall mattress assembly 800 (divided longitudinally), and the second elastomeric cushioning element section 804 may be centered longitudinally within a second half 808 of the overall mattress assembly 800. In some embodiments, each of the first elastomeric cushioning element section 802 and the second elastomeric cushioning element section 804 may have a width within a range of about 22.0 inches to about 28.0 inches. For instance, each of the first and second elastomeric cushioning element sections 802, 804 may have a width of about 25.0 inches. Furthermore, each of the first and second elastomeric cushioning element sections 802, 804 may have a length (e.g., longitudinal length) within a range of about 50.0 inches to about 65 inches. For example, the first and second elastomeric cushioning element sections 802, 804 may have a length of about 56.0 inches. Furthermore, a polyurethane foam 810 may be disposed where coverage is not provided by the first and second elastomeric cushioning element sections 802, 804. In some instances, the polyurethane foam 810 may include a polyurethane foam having a nominal density of about 2.0 lb/ft$^3$ and 18 ILD.

As shown in FIG. 9, in some embodiments, the elastomeric cushioning element 902 may provide complete coverage over a mattress assembly 900. For example, the elastomeric cushioning element 902 may cover at least substantially an entire upper surface of the upper layer 106 (FIG. 2) of the mattress assembly 900.

Figure 10:
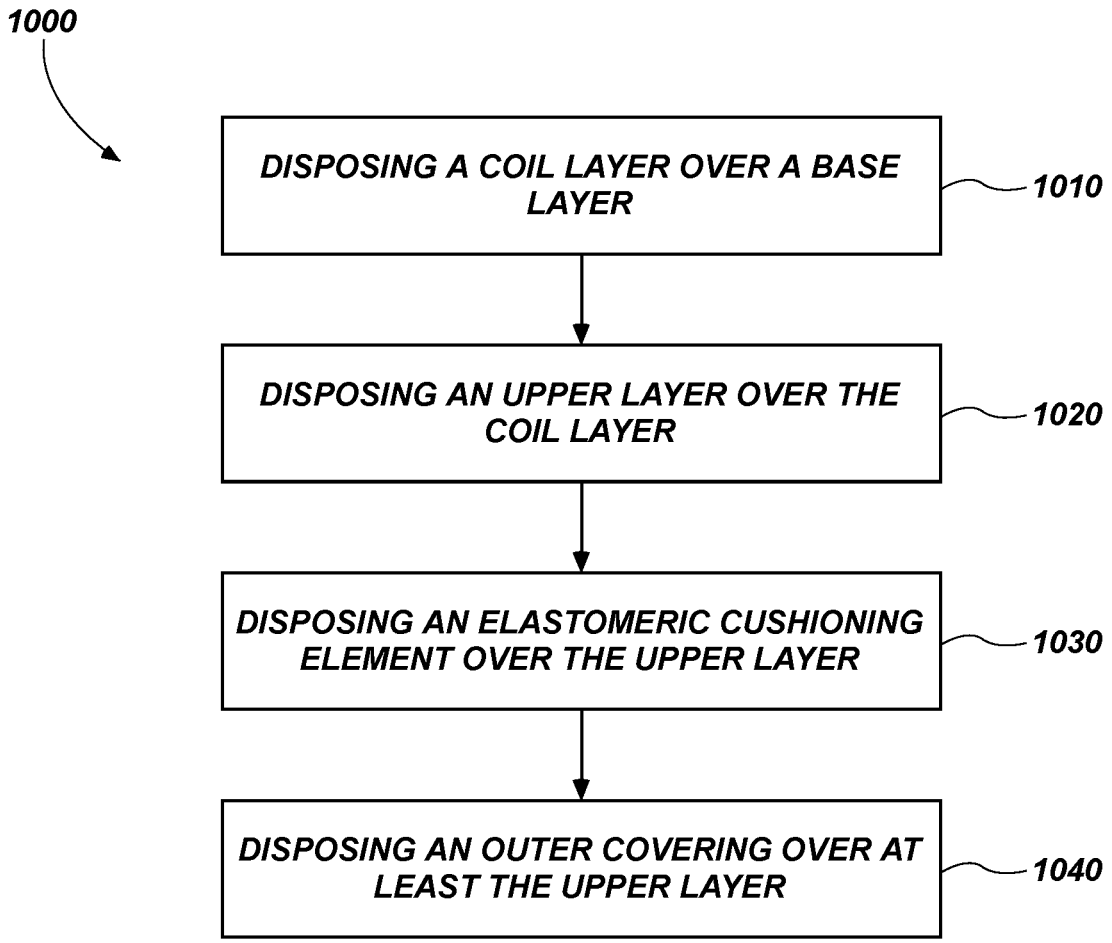
FIG. 10 is a flowchart of a method of forming a mattress assembly according to one or more embodiments of the present disclosure.

FIG. 10 shows a schematic flowchart of a method 1000 of forming a mattress assembly 100. In some embodiments, the method 1000 may include an act 1010 of disposing a coil layer 104 over a base layer 102. For example, act 1010 may include disposing a plurality of coils 118 within a plurality of casings 120, wherein each coil 118 of the plurality of coils 118 is disposed within at least two respective casings 120, and disposing the plurality of coils 118 over the coil layer 104. Additionally, act 1010 can include disposing the plurality of coils 118 within polypropylene bags. Furthermore, act 1010 may include orienting the plurality of coils 118 within an array (e.g., rows and columns) over the base layer 102. Moreover, act 1010 may include disposing the coil layer 104 over the base layer 102 according to any of the configurations described above in regard to FIGS. 1, 2, and 4-7.

Additionally, the method 1000 may include an act 1020 of disposing an upper layer 106 over the coil layer 104. In some embodiments, act 1020 may not include disposing a stabilization material between the coil layer 104 and the upper layer 106. However, in some embodiments, act 1020 may include disposing an adhesive between the coil layer 104 and the upper layer 106. For example, act 1020 may include disposing any of the adhesives described above between the coil layer 104 and the upper layer 106. Furthermore, act 1020 may include disposing an upper layer 106 over the coil layer 104 according to any of the configurations described above in regard to FIGS. 1, 2, and 4-7.

Moreover, the method 1000 may include an act 1030 of disposing an elastomeric cushioning element 108 over the upper layer 106. For example, act 1030 can include disposing an elastomeric cushioning element 108 over the upper layer 106 that comprises between about 15.0% and about 32.0% of an overall thickness of the mattress assembly 100. For instance, a thickness of the elastomeric cushioning element 108 comprises between about 20.0% and about 32.0% of an overall thickness of the mattress assembly 100. In additional embodiments, act 1030 can include disposing an elastomeric cushioning element 108 over the upper layer 106 that comprises between about 25.0% and about 32.0% of an overall thickness of the mattress assembly 100. In further embodiments, act 1030 can include disposing an elastomeric cushioning element 108 over the upper layer 106 that comprises between about 30.0% and about 32.0% of an overall thickness of the mattress assembly 100. For instance, act 1030 can include disposing an elastomeric cushioning element 108 over the upper layer 106 that comprises about 30.8% of an overall thickness of the mattress assembly 100.

In some embodiments, act 1030 can include disposing a plurality of elastomeric cushioning element 108 segments over the upper layer 106. Moreover, act 1030 can include disposing an elastomeric cushioning element 108 over the upper layer 106 according to any of the configurations described above and including any of the materials described in regard to FIGS. 1-9.

Additionally, the method 1000 may include act 1040 of disposing an outer covering 112 over at least the upper layer 106. For example, act 1040 can include disposing an outer covering 112 over the mattress assembly 100 such that the outer covering 112 covers at least substantially an entirety of the upper layer 106 and side panels 114 of the mattress assembly 100. In one or more embodiments, the method 600 can include disposing an adhesive between any of the layers of the mattress assembly 100.

Additional non-limiting example embodiments of the disclosure are described below.

Embodiment 1: A mattress assembly, comprising: a base layer; a coil layer disposed over the base layer, the coil layer comprising a plurality of pocketed coils; an upper layer disposed over the coil layer; and an elastomeric cushioning element disposed over the upper layer, wherein the elastomeric cushioning element has a thickness within a range of about 2.0 inches to about 4.5 inches.

Embodiment 2: The mattress assembly of Embodiment 1, wherein the coil layer has a thickness within a range of about 6.00 inches and about 8.00 inches.

Embodiment 3: The mattress assembly of Embodiment 2, wherein the coil layer has a thickness of about 7.50 inches.

Embodiment 4: The mattress assembly of Embodiment 1, further comprising: one or more side panels extending around outer perimeters of the base layer and the upper layer; and an outer covering disposed over the upper layer at least partially around the one or more side panels.

Embodiment 5: The mattress assembly of Embodiment 1, wherein the base layer and the upper layer both comprise a polyurethane foam.

Embodiment 6: The mattress assembly of Embodiment 1, wherein the elastomeric cushioning element has a thickness of about 4.0 inches.

Embodiment 7: The mattress assembly of Embodiment 1, further comprising an adhesive disposed between the elastomeric cushioning element and the upper layer.

Embodiment 8: The mattress assembly of Embodiment 7, wherein the adhesive comprises a latex water based adhesive.

Embodiment 9: The mattress assembly of Embodiment 1, wherein the base layer has a thickness within a range of about 0.75 inch and about 1.50 inches, and wherein the upper layer has a thickness within a range of about 0.25 inch and about 0.75 inch.

Embodiment 10: A mattress assembly, comprising: a base layer; a coil layer disposed over the base layer, the coil layer comprising a plurality of pocketed coils, each pocketed coil of the plurality of pocketed coils comprises: a plurality of casings; and a coil disposed within the plurality of casings; an upper layer disposed over the coil layer; and at least one elastomeric cushioning element disposed over the upper layer, wherein the at least one elastomeric cushioning element has a thickness within a range of about 2.0 inches to about 4.5 inches.

Embodiment 11: The mattress assembly of Embodiment 10, wherein the plurality of pocketed coils is oriented next to each other in a grid pattern.

Embodiment 12: The mattress assembly of Embodiment 10, wherein the plurality of casings of each pocketed coil comprises: a first casing; and a second casing disposed within the first casing, wherein the coil is disposed within the second casing.

Embodiment 13: The mattress assembly of Embodiment 10, wherein the at least one elastomeric cushioning element comprises a plurality of distinct elastomeric cushioning elements disposed at different locations over the upper layer.

Embodiment 14: The mattress assembly of Embodiment 10, wherein the at least one elastomeric cushioning element does not cover an entirety of an upper surface of the upper layer.

Embodiment 15: The mattress assembly of Embodiment 11, wherein the at least one elastomeric cushioning element comprises interconnected buckling walls.

Embodiment 16: A method of forming a mattress assembly, comprising: disposing a coil layer over a base layer; disposing an upper layer over the coil layer; disposing an elastomeric cushioning element over the upper layer, wherein a thickness of the elastomeric cushioning element comprises between about 15.0% and about 32.0% of an overall thickness of the mattress assembly; and disposing an outer covering over at least the upper layer.

Embodiment 17: The method of Embodiment 16, wherein disposing a coil layer over a base core layer comprises: disposing a plurality of coils within a plurality of casings, wherein each coil of the plurality of coils is disposed within at least two respective casings; and disposing the plurality of coils over the coil layer.

Embodiment 18: The method of Embodiment 17, wherein disposing a plurality of coils within a plurality of casings comprises disposing the plurality of coils within polypropylene bags.

Embodiment 19: The method of Embodiment 16, wherein the elastomeric cushioning element comprises about 30.8% of the overall thickness of the mattress assembly.

Embodiment 20: The method of Embodiment 16, further comprising disposing an adhesive between the elastomeric cushioning element and the upper layer.

While the present disclosure has been described herein with respect to certain illustrated embodiments, those of ordinary skill in the art will recognize and appreciate that it is not so limited. Rather, many additions, deletions, and modifications to the illustrated embodiments may be made without departing from the scope of the disclosure as hereinafter claimed, including legal equivalents thereof. In addition, features from one embodiment may be combined with features of another embodiment while still being encompassed within the scope of the disclosure as contemplated. Further, embodiments of the disclosure have utility with different and various mattress types and configurations.

What is claimed:

1. A mattress assembly, comprising:

a pocketed coil layer comprising a plurality of coils;

a stabilization layer comprising a scrim fabric;

an elastomeric cushioning element on the stabilization layer, an elastomeric material of the elastomeric cushioning element seeping through the stabilization layer to secure an upper surface of the stabilization layer to the elastomeric cushioning element, the elastomeric material exposed and defining a reduced slip surface or a non-slip surface on a lower surface of the stabilization layer;

a plurality of foam segments adjacent to the elastomeric cushioning element, the elastomeric cushioning element and the plurality of foam segments forming a substantially planar upper surface;

an upper layer disposed over the coil layer, wherein the reduced slip surface or the non-slip surface is positioned against an upper surface of the upper layer, the plurality of foam segments positioned above the upper layer and the coil layer; and an outer covering encasing the coil layer, the stabilization layer, the upper layer, the elastomeric cushioning element, and the plurality of foam segments.

2. The mattress assembly of claim 1, further comprising: a base layer beneath the pocketed coil layer.

3. The mattress assembly of claim 2, wherein the base layer comprises a compressible, resilient foam.

4. The mattress assembly of claim 1, wherein the upper layer comprises a compressible, resilient foam.

5. The mattress assembly of claim 1, wherein the pocketed coil layer comprises a plurality of individually pocketed coils.

6. The mattress assembly of claim 1, wherein the pocketed coil layer has a thickness of about 6.00 inches to about 8.00 inches.

7. The mattress assembly of claim 1, wherein the elastomeric cushioning element has a thickness of about 2.0 inches to about 4.5 inches.

8. The mattress assembly of claim 1, further comprising: an adhesive disposed between the stabilization layer and the upper layer.

9. The mattress assembly of claim 8, wherein adhesive is not disposed over at least a portion of the upper layer.

10. A mattress assembly, comprising:

a coil layer comprising a plurality of pocketed coils;

an upper layer over the coil layer;

a stabilization layer comprising a scrim fabric; and at least one elastomeric cushioning element on the stabilization layer, an elastomeric material of the at least one elastomeric cushioning element seeping through the scrim fabric of the stabilization layer to secure an upper surface of the stabilization layer to the at least one elastomeric cushioning element and to provide a non-slip surface or a reduced slip surface on a lower surface of the scrim fabric, the non-slip surface or the reduced slip surface positioned against an upper surface of the upper layer;

a plurality of foam segments adjacent the elastomeric cushioning element, the elastomeric cushioning element and the plurality of foam segments forming a substantially planar upper surface, and the plurality of foam segments positioned above the upper layer and the coil layer; and an outer covering encasing the coil layer, the upper layer, the stabilization layer, the at least one elastomeric cushioning element, and the plurality of foam segments, wherein the at least one elastomeric cushioning element covers a portion of an upper surface of the upper layer.

11. The mattress assembly of claim 10, wherein each pocketed coil of the pocketed coils comprises:

a plurality of nested casings; and a single coil disposed within an innermost casting of the plurality of nested casings.

12. The mattress assembly of claim 10, wherein the at least one elastomeric cushioning element comprises a plurality of distinct elastomeric cushioning elements disposed at different locations over the upper layer.

13. The mattress assembly of claim 10, wherein the at least one elastomeric cushioning element comprises a grid of interconnected walls defining hollow buckling columns.

14. The mattress assembly of claim 10, further comprising:

an adhesive disposed between the stabilization layer and the upper layer.

15. A method of forming a mattress assembly, comprising:

providing a pocketed coil layer;

disposing an elastomeric cushioning element including a stabilization layer and a non-slip surface or a reduced slip surface formed by elastomeric material on a lower surface of the stabilization layer over the coil layer, the stabilization layer being located on a bottom surface of the elastomeric cushioning element, the elastomeric material of the elastomeric cushioning element securing the elastomeric cushioning element to an upper surface of the stabilization layer;

disposing a plurality of foam segments adjacent to the elastomeric cushioning element, the elastomeric cushioning element and the plurality of foam segments forming a substantially planar upper surface;

disposing an upper layer over the coil layer such that the elastomeric cushioning element is disposed over the upper layer, wherein the non-slip surface or reduced slip surface is positioned against an upper surface of the upper layer, the plurality of foam segments positioned above the upper layer and the coil layer; and encasing the coil layer, the upper layer, the elastomeric cushioning element, and plurality of foam segments in an outer casing.

16. The method of claim 15, wherein providing the pocketed coil layer comprises providing a pocketed coil layer in which each coil of the pocketed coil layer is individually disposed within a first casing and each first casing is individually disposed within a second casing.

17. The method of claim 15, wherein disposing the elastomeric cushioning element comprises disposing the elastomeric material on the lower surface of the stabilization layer against the upper layer.

18. The method of claim 15, further comprising:

securing the stabilization layer to the upper layer.

19. The method of claim 15, further comprising:

disposing an adhesive between the stabilization layer and the upper layer.

* * * * *